United States Patent [19]

Doubleday

[11] 3,950,014

[45] Apr. 13, 1976

[54] SUCTION PIPE FOR DUST OR LIQUID SUCTION DEVICE

[76] Inventor: Eric G. Doubleday, Am Kraherwald 167, 7 Stuttgart-W, Germany

[22] Filed: Jan. 6, 1975

[21] Appl. No.: 539,013

[30] Foreign Application Priority Data

Jan. 10, 1974 Germany ..... 2401006

[52] U.S. Cl. ..... 285/7; 285/27; 285/260; 285/330; 285/DIG. 22

[51] Int. Cl.[2] ..... A47L 9/24; F16L 37/08

[58] Field of Search ... 285/7, 27, 260, 330, DIG. 22

[56] References Cited

UNITED STATES PATENTS

| | | | |
|---|---|---|---|
| 1,175,402 | 3/1916 | Baylis | 285/7 |
| 2,142,149 | 1/1939 | Replogle | 285/7 |
| 2,580,725 | 1/1952 | Breckenridge | 285/175 |
| 2,712,950 | 7/1955 | Siebert | 285/7 |
| 2,982,586 | 5/1961 | Gliebe | 285/DIG. 22 |
| 3,413,021 | 11/1968 | Potts | 285/330 |

FOREIGN PATENTS OR APPLICATIONS

| | | | |
|---|---|---|---|
| 636,423 | 2/1962 | Canada | 285/330 |

*Primary Examiner*—Richard E. Aegerter
*Assistant Examiner*—Richard R. Stearns
*Attorney, Agent, or Firm*—Walter Becker

[57] ABSTRACT

A sectioned suction pipe, especially for a cleaning device, in which the pipe sections have plug and sleeve portions for telescopic engagement. Each plug portion has a radial protuberance receivable in a recess in the sleeve portion of the adjacent pipe section. Each sleeve portion has an axial incision along each side of the recess therein to impart resiliency thereto and a groove is formed inside each sleeve portion to guide the protuberance toward the recess.

7 Claims, 5 Drawing Figures

SUCTION PIPE FOR DUST OR LIQUID SUCTION DEVICE

The present invention relates to a suction tube for dust or liquid suction devices, which comprises a plurality of substantially identical tube sections. Each of said tube sections at one of its end portions is designed as a receiving sleeve for the other end section of the adjacent tube portion and is provided with an arresting recess, said other end section being designed as plug member. The said arresting recess is adapted to be engaged by an arresting nose arranged on the plug member of the adjacent tube section.

With heretofore known dust and liquid suction devices, the pipe sections intended to be plugged into each other are drawn out of metal and have their outside surface finished and at one of their two end sections are widened to such an extent that the other cylindrical or slightly conical end section of the adjacent tube section can be slipped with tight fit onto the receiving sleeve. These known suction tubes are, in view of the required tolerances which have to be kept in order to obtain a tight connection between two adjacent tube sections and for obtaining a non-rotatable connection between two adjacent tube sections, expensive to manufacture while the costs are considerably increased for the surface finishing for instance if a chrome finish is desired.

For the user it is furthermore disadvantageous that the tube sections may when subjected to a strong mechanical impact, for instance when hitting a non-yieldable object, deform permanently. Already minor deformation may bring about that when plugging adjacent tube sections into each other, the desired tight sealing effect can no longer be obtained. Still another drawback of the heretofore known suction tubes of metallic tube sections consists in that the metallic tube sections have a relatively great weight which fact increases the transporting costs and makes the handling so much more difficult.

The heretofore known suction tubes have still another drawback namely that the finished, especially chrome or nickel plated tubes while being protected on the outside against the attack of liquids, makes it nearly impossible to finish the inside of a relatively long tube. This fact brings about that the tubes will corrode or rust on their inside within a short time. Two tube sections plugged into each other will then no longer be separable from each other because they are fixedly connected to each other by the corrosion layers, for instance rust. Moreover, the connection of two tubes of plugged-together tube sections, or one tube with a nozzle, is rather soil sensitive. This connection can be disengaged only under great difficulties when soil, sand, small pebbles, for instance, have become jammed between the two respective adjacent tube sections. While there are, of course, other possibilities to connect tube sections to each other, for instance by various types of bayonet joints or rotary joints, it is a well-known fact that also these connecting types have drawbacks. Rotary connections are expensive and are furthermore as sensitive to soiling as are bayonet joints.

It is, therefore, an object of the present invention at a merging area to produce tube sections of synthetic material for instance a suction tube of the above mentioned type, and to produce such pipe sections in such a way that the pipe sections after being plugged together will remain reliably connected to each other even when due to the unfavorable shrinkage of synthetic materials, the tolerance limits are considerably greater than those customary with metallic tube sections of suction tubes.

These and other objects and advantages of the invention will appear more clearly from the following specification in connection with the accompanying drawings, in which.

The suction tube according to the present invention is characterized primarily in that the tube sections preferably made of duroplastic synthetic material have that end section thereof which forms the receiving sleeve provided with a mantle strip defined by two axis-parallel longitudinal slots as to width and length, said mantle strip being marked relative to the remaining mantle surface of the tube section and being connected at both ends to the mantle of the tube section while forming one piece therewith, said mantle strip also containing the arresting recess.

Advantageously, the arresting nose which projects beyond the circumferential surface of the plug member may be molded as one piece to the plug member. Since in view of the design according to the invention, the mantle strip at the receiving sleeve has a sufficient spring elasticity in view of the two longitudinal slots, the circumferential surface of the plug member carrying the arresting nose may be designed as a smooth cylinder mantle surface and need not contain any additional slots as is necessary with heretofore known designs of tube sections made of steel. Since furthermore the spring elastic mantle strip is at the receiving sleeve at both ends connected with the mantle of the tube section so as to form one piece therewith, also the danger of fatigue damage or the like will be avoided so that the arresting effect as well as the necessary seal will be assured. At the end of the suction tubes of dust or liquid suction devices, frequently nozzles are mounted which are made of rubber and have a tubular cylindrical connection. Since with the design of the tube sections according to the invention the spring elastic mantle strip is arranged on the outer tube, the plug member, due to its precisely cylindrical shape will assure a proper seal and a safe arresting in such rubber nozzles.

With the heretofore known suction tubes difficulties are encountered when introducing the arresting nose designed as a knob-like elevation and provided at the free end of a tongue formed by two longitudinal slots, into the adjacent tube section in such a way that the arresting nose precisely meets the arresting recess. This is due to the fact that when carrying out the plugging operation the view of the arresting nose is shrouded and therefore the arresting recess must first be found by turning the two adjacent tube sections.

In order to overcome these difficulties and to facilitate the plugging operation, it is provided according to a further development of the operation that at that end section of the tube section which serves as a receiving sleeve, there is provided an introducing passage which is designed in conformity with the width of the arresting nose and extends in an axis-parallel manner and up to the end face of the tube section.

Figure 1:
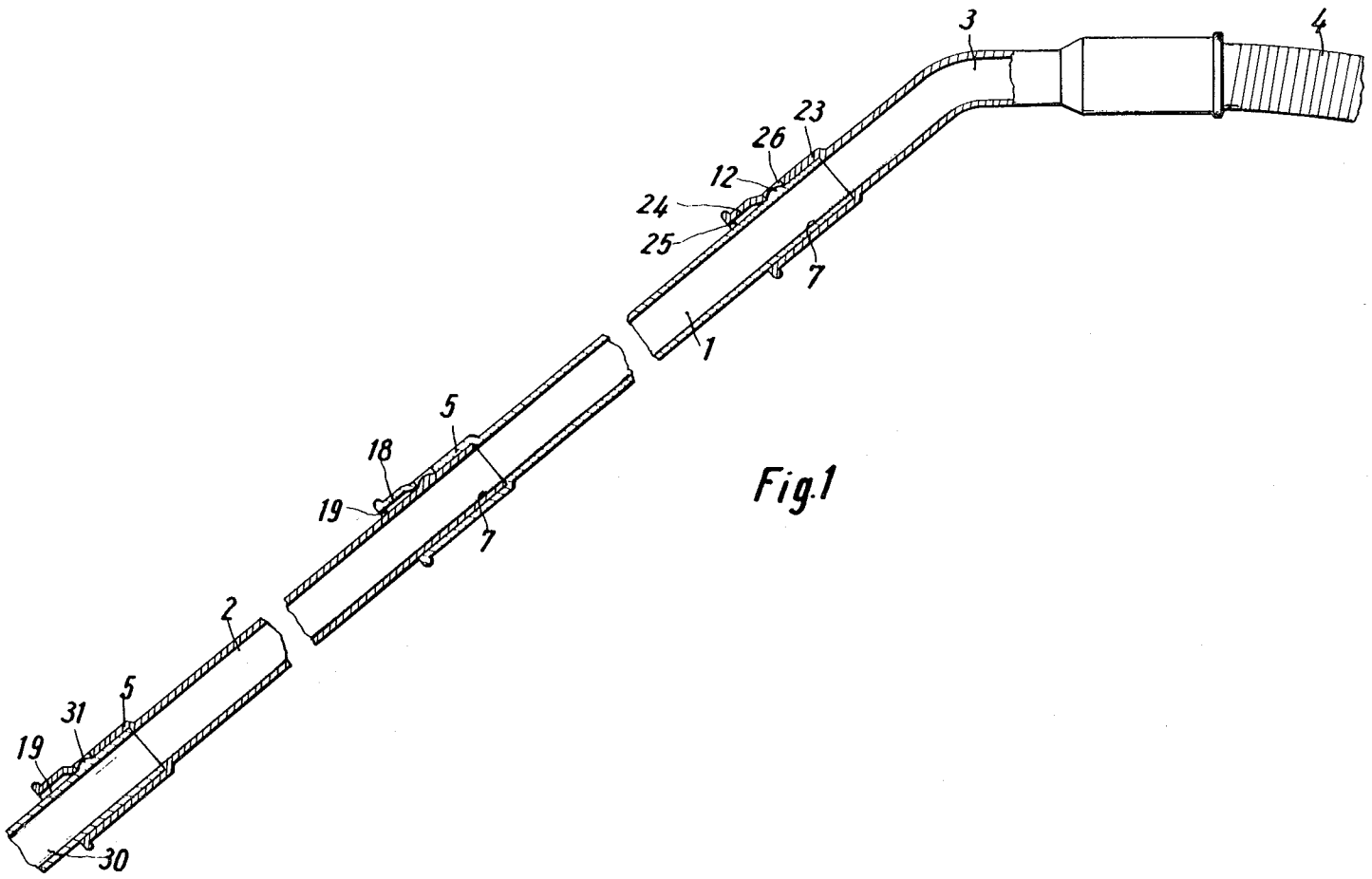
FIG. 1 illustrates a section through a portion of a suction tube according to the invention and in part illustrates a side view of the suction tube.
Figure 2:
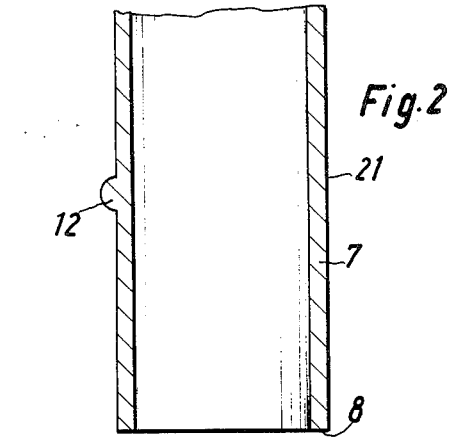
FIG. 2 represents an axial longitudinal section through the plug member of one of the pipe sections of the suction tube according to FIG. 1.
Figure 4:
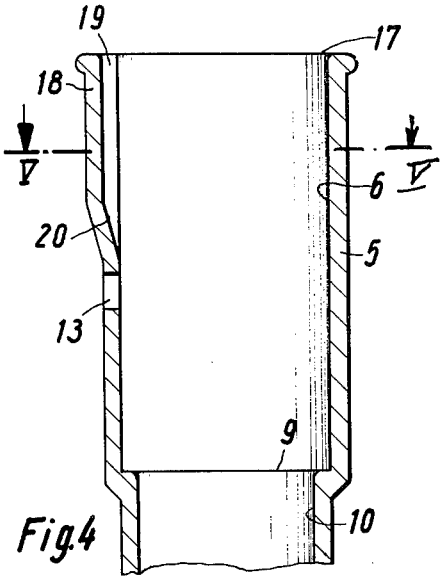
FIG. 4 illustrates a longitudinal section of a receiving sleeve, said section being taken along the line IV—IV of FIG. 3.

Referring now to the drawings in detail, the illustrated suction tube comprises a plurality of substantially identical tube sections which are adapted to be plugged together. FIG. 1 shows merely two tube sections 1 and 2. These tube sections are injection molded of duroplastic material similar to an angled-off hand tube 3 and a flexible hose 4 coupled to said tube 3.

The tube sections 1 and 2 are over the major length thereof designed cylindrically and at one of their end sections merge with a receiving sleeve 5 which has a receiving bore 6 into which the other end section of an adjacent pipe section serving a plug member 7 can be inserted with tight connection until the end face 8 of this plug member engages an inner shoulder between the receiving bore 6 and the longitudinal bore 10 of the receiving sleeve 5.

Figure 3:
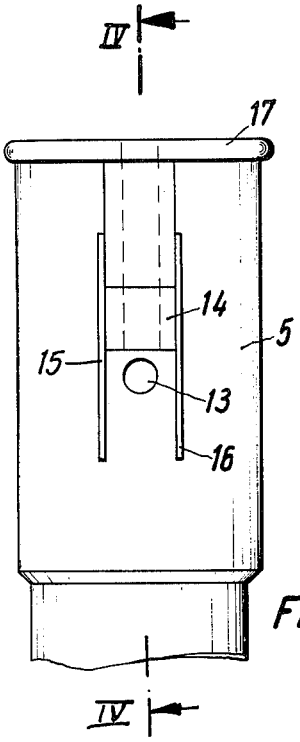
FIG. 3 illustrates a view of the receiving sleeve of such tube section and shows the spring elastic mantle strip.

In order to safeguard the connection obtained by plugging the tube sections together against an accidental disengagement, the mantle of the plug member 7 of the tube sections has mounted thereon an approximately semispherical outwardly projecting arresting nose 12 located at a slight distance from the end face of the plug member 7, said nose 12 forming one part with said mantle. It should be noted that the mantle is cylindrical throughout its length. For purposes of receiving such arresting nose, the other end section 5 of a tube section forms a receiving sleeve and is provided with a bore-like arresting recess 13. This recess 13 is located approximately at the center of a mantle strip 14. Width and length thereof relative to the remaining mantle surface of the receiving sleeve 5 is defined or limited by two longitudinal slots 15 and 16 which extend in an axis-parallel manner to each other and are slightly spaced from each other. As is clearly shown in FIG. 3, these longitudinal slots, in contrast to the heretofore known embodiments of suction tubes adapted to be plugged together, do not extend to the end face 17 but end at a distance from said end face which distance equals approximately the width of the mantle strip 14. This brings about that the mantle strip 14 remains connected at both ends as one piece with the receiving sleeve 5 and with a good bending elasticity has a considerable returning force without creating the danger of fatigue damage, when during the plugging together operation the arresting nose 12 of an adjacent tube section presses said mantle strip first toward the outside until the arresting nose 12 finally engages the recess 13.

Figure 5:
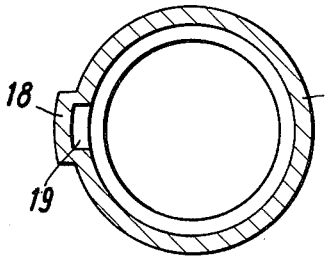
FIG. 5 is a section through the receiving sleeve, said section being taken along the line V—V of FIG. 4.

In order so to guide the arresting nose 12 during the plugging operation in a longitudinal direction and to assure that the arresting nose will directly fit into the arresting recess 13, a longitudinal rib 18 (FIG. 5) starting at the end face 17 of the receiving sleeve 5 is formed therewith. This rib 18 comprises an introducing passage 19 designed in conformity with the width of the arresting nose 12 and extending in an axis-parallel manner. This passage 19 remains visible during the introduction of the plug member 7 into the receiving sleeve 5 so that the arresting nose 12 can without difficulties be inserted into the introducing passage. When further pushing the plug end 7 forwardly, the arresting nose 12 is pressed radially inwardly by an inclined surface 20 which shortly ahead of the arresting recess 13 merges with the bore wall 6 and then the arresting nose 12 can directly engage the arresting recess 13. In this rest position, the two adjacent tube sections 1 and 2 are kept connected to each other so as to be safeguarded against longitudinal pull. In this connection it is particularly advantageous that the outer surface 21 of the plug member 7, which surface, with the exception of the arresting nose 12 is cylindrical throughout, is adapted to cover up the two longitudinal slots 15 and 16 in an air- and liquid-tight manner. Similar to the two tube sections 1 and 2, also the hand tube 3 has a receiving sleeve 23 for the plug member 7 of the tube section 1. This receiving sleeve comprises in a longitudinal rib 24 likewise an axis-parallelly extending introducing passage 25 which secures the arresting nose 12 on the plug member 7 against accidental turning and during the plugging operation precisely guides in the arresting recess 26 of the receiving sleeve 23.

For purposes of connecting auxiliary parts not shown in the drawing, for instance, variously designed suction mouths or suction nozzles, connections 30 are provided for these auxiliary parts which connections 30 are designed in the same shape as the plug members 7 of the tube members 1 and respectively carry an outwardly projecting arresting nose 31 forming one piece with said connection. These connections 30 selectively instead of a further extension tube section not illustrated in the drawing may be plugged into the receiving sleeve 5 of the lower tube section 2 in the above mentioned manner while the arresting nose 31 is secured in the passage 19 against lateral rotation.

It is, of course, to be understood that the invention is, by no means, limited to the specific showing in the drawings, but also comprises any modifications within the scope of the appended claims.

What is claimed is:

1. A suction pipe, or wand, for a suction cleaning device comprising a plurality of pipe sections adapted for end to end interconnection, each region of interconnection of adjacent pipe sections comprising a sleeve portion on the end of one pipe section and a plug portion on the end of the other pipe section receivable in the sleeve portion, a radial protuberance on said plug portion and a recess in the sleeve portion to engage said protuberance when the pipe sections are interconnected, at least said plug and sleeve portions of the pipe sections being formed of resilient material, an axial incision in said sleeve portion on each side of said recess and having one end extending in a direction away from the outer end of the sleeve portion at least to said recess and each of said incisions terminating at the other end thereof in said sleeve portion between the recess and the mouth of said sleeve portion.

2. A suction pipe according to claim 1 which includes an axial groove inside said sleeve portion axially aligned with said recess, said groove terminating in an incline along which the protuberance is slidable in approaching said recess.

3. A suction pipe according to claim 1 in which said protuberance is integral with said plug portion.

4. A suction pipe according to claim 2 in which said groove is molded in said sleeve portion and is about the same width as said protuberance.

5. A suction pipe according to claim 4 in which said sleeve portion is formed with an external axial rib and said groove being on the inside of said rib.

6. A suction pipe according to claim 1 in which said sleeve portion has a shoulder thereon engageable with the end of said plug portion when said protuberance is in said recess.

7. A suction pipe according to claim 1 in which the pipe sections are in the form of one piece moldings.

* * * * *